US005575038A

United States Patent [19]

Varga et al.

[11] Patent Number: 5,575,038

[45] Date of Patent: Nov. 19, 1996

[54] METHOD OF CARDING

[75] Inventors: Andre Varga, Halifax; Harry Cripps, Stockport, both of Great Britain

[73] Assignee: Carding Specialists (Canada) Limited, Toronto, Canada

[21] Appl. No.: 244,159

[22] PCT Filed: Sep. 10, 1992

[86] PCT No.: PCT/GB92/01659

§ 371 Date: Jul. 22, 1994

§ 102(e) Date: Jul. 22, 1994

[87] PCT Pub. No.: WO93/06274

PCT Pub. Date: Apr. 1, 1993

[30] Foreign Application Priority Data

Sep. 20, 1991 [GB] United Kingdom ..... 9120128

[51] Int. Cl.[6] ..... D01G 15/24; D01G 15/36

[52] U.S. Cl. ..... 19/98; 19/101; 19/105

[58] Field of Search ..... 19/98, 105, 101

[56] References Cited

U.S. PATENT DOCUMENTS

| | | | |
|---|---|---|---|
| 3,373,461 | 3/1968 | Bessette et al. | 19/98 |
| 4,438,548 | 3/1984 | Grunder | 19/105 |
| 4,580,318 | 4/1986 | Varga | 19/102 |
| 4,922,579 | 5/1990 | Varga | 19/105 |
| 5,287,600 | 2/1994 | Wespi | 19/105 X |

FOREIGN PATENT DOCUMENTS

| | | |
|---|---|---|
| 1567066 | 5/1969 | France . |
| 1510331 | 9/1969 | Germany . |
| 2237876 | 3/1973 | Germany . |
| 3507242 | 11/1985 | Germany . |

*Primary Examiner*—John J. Calvert

*Attorney, Agent, or Firm*—Merchant, Gould, Smith, Edell, Welter & Schmidt

[57] ABSTRACT

A method of carding a fibrous feedstock to form a carded sliver uses a carding engine (10) having a main toothed wire cylinder (11), a taker-in (12), a doffer (13), and a series of flats (14) movable along a closed loop (15) having a working path (16) arranged alongside the outer periphery of the cylinder (11) between the taker-in (12) and the doffer (13) in order to carry out a carding operation on the feedstock in cooperation with the teeth of the rotating cylinder (11) and to remove waste or trash particles and short fibers from the feedstock, in which the cylinder (11) is driven to run at normal production speed giving a circumferential speed Y of e.g. 60,000 inches per minute whereas the linear speed X of the flats (14) is a substantially increased speed compared to normal running speeds e.g. at least 16 inches per minute, thereby to produce a sliver with surprisingly improved quality which can approach that of a carded, and subsequently semi-combed (scratch-combed) or combed sliver.

16 Claims, 4 Drawing Sheets

METHOD OF CARDING

BACKGROUND OF THE INVENTION

This invention relates to a method of carding a fibrous feedstock to form a carded sliver using a carding engine having a main toothed wire cylinder, a takerin, a doffer, and a series of flats movable along a closed loop having a working path arranged alongside the outer periphery of the cylinder between the takerin and the doffer in order to carry out a carding operation on the feedstock in co-operation with the teeth of the rotating cylinder and to remove trash particles, nep, dust and short fibres from the feedstock to form the carded sliver.

In commercial production of carded webs to form a sliver, it is usual to run the cylinder such that the circumferential speed of the cylinder periphery is about 60,000 inches per minute. Thus, for a 40 inch diameter cylinder, a typical speed of revolution would be about 500 rpm. These figures are given by way of general explanation only, and typical cylinder dimensions and operating speeds vary from one manufacturer to another.

By contrast, a typical linear speed of the revolving flats along the working path is of a very considerably lower order, with a typical speed being about 6 inches per minute i.e. the ratio of flats speed X to cylinder peripheral speed Y is about 1:10,000.

As is well known in the carding art, the fibrous feedstock fed to the cylinder by the takerin is conveyed into the carding zone where the combined action of the high speed cylinder wires or teeth and the much slower speed wires or teeth of the flats exert a carding action on the feedstock to form a carded web, while in addition the flats remove unwanted material from the feedstock in the form of trash particles, nep, dust and short fibres which constitute flat strip waste.

The waste will include small fragments of seeds, husks and also undesired short fibres, so that the resulting web is composed mainly of fibres of usable length. The required amount of short fibres to be removed will depend upon the required quality of sliver to be derived from the web, and the operating parameters will be set-up to suit particular sliver quality requirements.

As mentioned above, the speed of the flats is very small compared to the peripheral speed of the cylinder, and it has always been assumed that this order of flats speed was. necessary in order to carry out a carding operation which is both technically efficient in producing a carded web which can produce a sliver of required quality, and also economic in its usage of the raw material feedstock.

With regard to the matter of economic usage of the raw material, the quality of the sliver depends upon the proportion of short fibres initially present in the feedstock, which still remain in the carded web after carding treatment, and therefore it is desirable to operate the carding engine in such a way as to minimise the residual short fibre content in the web. However, it has always been conventional wisdom that any alteration to the operating parameters to achieve increased removal of short fibres will necessarily involve an unacceptable raw material cost penalty by reason of an inevitable increase in extraction of fibres of usable length (typically about 1 inch).

Therefore, typical running speeds of flats of about 6 inches per minute are considered to be an acceptable compromise between the conflicting requirements of (a) maximising the cleaning efficiency and removal of short fibres and other undesired waste from the feedstock to obtain a required quality of sliver and (b) minimising the loss of acceptable fibres from the feedstock to avoid commercial under utilisation of the raw material resource.

Such typical running speeds have been used for many years, and have been found to provide a satisfactory quality of sliver consistent with economic utilisation of the raw material, and further, and most importantly, have provided reliable operation over extended periods, during which the radial clearances between the flats and the cylinder periphery remain within acceptable limits. The maintenance of these clearances is very important to consistent sliver quality, and it is desirable for the flats and cylinder to run for time intervals as long as possible before it becomes necessary to carry out adjustment or re-grinding to re-establish the clearances within the acceptable limits.

One of the major causes of clearance variations over a period of time is wear between the flat ends and "flexible bends" which control the path of the flats around a closed loop, and a low running speed of the flats for a given speed of cylinder contributes to low wear. Therefore, for all of these reasons, and maybe others, it is totally accepted practice that flats run at speeds of the order indicated.

Despite the accepted wisdom prevailing amongst carding machine manufacturers and operators concerning the running speed of flats, the applicants did make some tentative experiments a number of years ago into possible variation in sliver quality which would result by reason of increasing the linear speed of the flats while maintaining normal production speeds of the cylinder. The results were considered at the time to be unsatisfactory, as there was unacceptable loss of long fibres which were carried over into the waste and which was discovered on inspection of the waste strips. Furthermore, there was no obvious improvement in the quality of the sliver, and no further work was done on this project. The experiment thus simply confirmed the prejudice against any contemplation of the assumed practicality of increasing the flats speed.

However, the applicants have recently undertaken further research on high speed flats and, despite repeated negative indications of improvement in the fibre profile of the sliver, nevertheless this has been pursued to the stage of knitting cloth using a rotor yarn spun from sliver produced by a carding engine on which the flats were run at high speed. The very surprising result of this has been to find that the quality of knitted fabric from a yarn derived from a sliver obtained on a single carding engine which is operated at increased speed of the flats is considerably improved as compared with the same carding engine operating at normal speeds. On detailed inspection of such fabric quality parameters as "evenness" and "hairiness" etc, the quality was found to be comparable to the quality of fabric obtained from so-called "scratch combed" quality yarn, i.e. yarn derived from a sliver which has been subjected to three separate process stages, namely carding in a conventionally operated carding engine followed by subsequent combing.

The reason why this highly surprising advantageous result is obtained is not clear at present, but experimental data derived to date clearly indicates that this result is achieved when the speed of the flats is increased substantially.

One possible explanation is that the key to the improvement lies in the making of a substantial increase in the ratio of flat speed X to cylinder peripheral speed Y, the increase being from a typical current value of 1:10,000 to a higher value i.e. at least 1.5:10,000, more preferably in the range of up to ten times greater, namely 1:1,000 and possibly even higher.

A further possible explanation is that the key factor is solely the increase in speed of the flats as such, regardless of cylinder speed. Thus, significantly advantageous results may be obtained with an increase of flat speeds to 16 inches per minute or more.

A still further possible explanation, which may be related to either or both of the above, is that the fibre tuft material caught by the high speed flat, and exposed to the wire action of the cylinder, is subjected to a lower number of cylinder wires acting on it than would be the case during the longer exposure time at a lower flats speed.

SUMMARY OF THE INVENTION

Accordingly, in one aspect of the invention there is provided a method of carding a fibrous feedstock to form a carded sliver using a carding engine having a main toothed wire cylinder, a takerin, a doffer, and a series of flats movable along a closed loop having a working path arranged alongside the outer periphery of the cylinder between the takerin and the doffer in order to carry out a carding operation on the feedstock in cooperation with the teeth of the rotating cylinder and to remove trash particles, nep, dust and short fibres from the feedstock, the flats having a linear speed along the working path of X inches per minute and the outer periphery of the cylinder having a circumferential speed of Y inches per minute;

characterised in that the ratio of X:Y is increased from the usual ratio so that the resulting sliver may approach the quality of a carded, and subsequently semi-combed (scratch-combed) or combed, sliver.

It should be appreciated that, with increased speed of the flats, smaller amounts of material will be removed by each flat after each passage along its working path, but per unit of time there will be an increased volume of material removed as compared with flats running at existing speeds.

It has been found by experiments that the percentage of short fibres in the material removed by individual flats does reduce with increased flats speed, but despite this there is still a substantial increase in amounts of short fibre removed per unit of time.

Preferably, the ratio of flats speed X to cylinder peripheral speed Y is increased by a factor of at least 1.5 compared to the ratio prevailing in existing designs of carding engine, and more desirably by a factor in excess of 5, and preferably up to as much as ten times conventional speed, or more. Preferred ratios are at least 1.5:10,000, more desirably at least 8:10,000. Good results may also be achieved at even higher ratios.

The method of the invention will utilise a substantially increased speed of the flats which is determined empirically for any given set of circumstances e.g. cylinder diameter, tooth density and type of feedstock, but initial experiments have shown that advantageous sliver characteristics can be obtained with the flats speed being increased by a factor of at least 1.5. For example, with a 40 inch diameter cylinder running at 500 rpm a flat linear speed of at least 10 inches per minute and more preferably at least 16 inches per minute will be used. The most desirable speeds will be even higher, and limits of 20 or 50 inches, or even 100 per minute may be suggested.

According to a further aspect of the invention there is provided a method of carding a fibrous feedstock to form a carded sliver using a carding engine having a main toothed wire cylinder, a takerin, a doffer, and a series of flats movable along a closed loop having a working path arranged alongside the outer periphery of the cylinder between the takerin and the doffer in order to carry out a carding operation on the feedstock in cooperation with the teeth of the rotating cylinder and to remove waste or trash particles and short fibres from the feedstock:

characterised in that the cylinder runs at normal production speed and the speed of the flats is a substantially increased speed compared to normal running speeds, and is at least 16 inches per minute.

The method of the invention may be applied advantageously to existing designs of carding engine, where a typical cylinder speed may give a circumferential speed of e.g. 60,000 inches per minute. However, the method may be applied to carding engines having increased speed of the cylinder e.g. operating at twice normal speed, while keeping the increased speed of the flats X at least 16 inches per minute, and preferably higher speed.

With current experimental data to hand, 16 inches per minute is the lowest speed at which a novel and advantageous effect is achieved, although further experimental data may show that these advantages can be achieved with even smaller increases in speed over the existing normal production speed of 6 inches per minute. More preferably speeds of at least 20 or at least 50 inches per minute are contemplated.

In view of the increased running speed of the flats, it is preferred to employ a carding engine having a roller bearing type of support for each movable flat, which minimises wear involved during movement of the flats along the flexible bends which define the closed loop, and it is particularly preferred to employ a carding engine utilising roller bearing type support for the movement of the flats as disclosed in more detail in U.S. Pat. No. 4580318.

The invention can be carried out by both co-current and counter-current movements of the flats relative to the cylinder rotation.

BRIEF DESCRIPTION OF THE DRAWINGS

The invention will now be described in more detail, by way of example only, with reference to the accompanying drawing in which.

DETAILED DESCRIPTION OF THE PREFERRED EMBODIMENT

Figure 1:
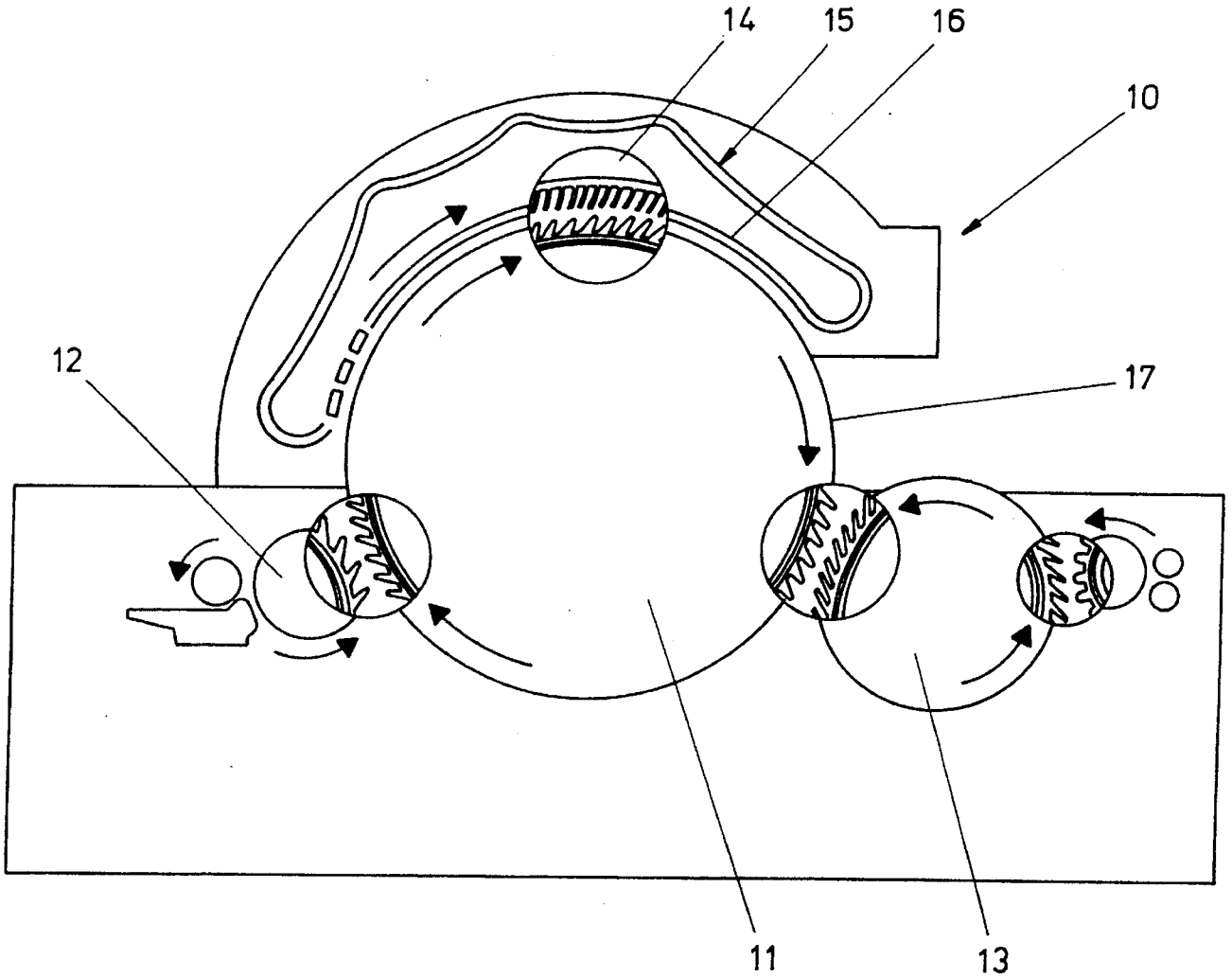
FIG. 1. is a schematic illustration of a known type of revolving flat carding machine which can be employed in carrying out a method according to the invention; and, FIG. 2 is a series of graphs 1, 2, and 3 showing how variation in speed of the flats causes variation respectively in (a) the percentage by weight of the flats strip, (b) the proportion of short fibres in the flats strip and (c) the short fibre as a percentage of weight fed.

Referring now to the FIG. 1 of the drawings, this shows in schematic form a carding engine designated generally by reference 10 for carding a fibrous feedstock, usually cotton, or a synthetic fibre, or a mixture of the two, to form a carded sliver, the engine having a main toothed wire cylinder 11, a takerin 12, a doffer 13, and a series of flats 14 movable along a closed loop 15 having a working path 16 arranged alongside the outer periphery 17 of the cylinder between the takerin 12 and the doffer 13 in order to carry out a carding operation on the feedstock in cooperation with the teeth of the rotating cylinder and to remove trash particles, neps, dust and short fibres from the feedstock.

The cylinder 11 may typically have a diameter of 40 inches and runs at about 500 rpm, which gives a circumferential speed of its outer periphery, during normal production, of about 60,000 inches per minute.

In the commercial production of carded webs to form a sliver using the existing design of machine shown in the drawing, the flats 14 move along the working path 16 at a linear speed of about 6 inches per minute. This design of machine and its mode of operation represents the current perceived wisdom in the art with regard to commercial production of sliver, as described earlier, in which an acceptable carding efficiency is achieved in removal of unwanted trash particles neps and short fibres to produce a sliver of required quality, consistent with an acceptable level of losses of good fibres in the flats waste strip.

However, in a method according to the invention, the linear speed X of the flats 14 is increased substantially from the current production speed of 6 inches per minute, to a speed of at least 16 inches per minute, and preferably with a speed multiplication factor, as compared to the existing speed, of preferably upwards of 2, and particularly advantageously in the range 8 to 10, and possibly even higher. However, this advantageous effect on sliver quality is achieved without any need to alter, or alter substantially the normal production speed of the main cylinder 11.

Taking one test result by way of example only, increase in the linear speed X of the flats 14 to 50 inches per minute while maintaining the peripheral speed Y of the cylinder at normal rotational speed of 60,000 inches per minute results in an increase in the ratio X:Y from the normal 1:10,000 to 8.33:10,000. An open end spun yarn derived from the sliver produced by a carding engine having this increased speed of the flats was knitted to form a fabric, and tests on the fabric with regard to qualities of "evenness" and "hairiness" etc showed that the fabric quality was comparable with that obtainable from a scratch combed yarn, and was very much superior to that obtainable from yarn spun from sliver delivered by the same carding engine operated at conventional speeds. Clearly, this provides significant enhancement to the operating performance of a carding engine, while enabling a lower capital cost and space requirement.

The method of the invention is particularly applicable to a single card, but can also be applied to advantage in a tandem card arrangement.

Experiments recently carried out with knitted fabric obtained from rotor spun yarn from carded sliver produced on the following machines were shown to be in the following order of quality:

1. A tandem card operated with high speed flats.
2. A single card operated with high speed flats.
3. The tandem card of 1 above, operating at normal speeds.
4. The single card of 2 above, operating at normal speeds.

Thus, one of the extremely surprising results obtained by the invention is that a single card may in some cases be thus operated to produce a yarn and fabric quality higher than that obtainable from a conventional tandem card.

There will now be described, by way of example only, the results of experiments carried out using a Crosrol Mk 4 single card, having a diameter of 40 inches and a rotational speed of 500 rpm, which gives rise to a circumferential speed Y of 62,840 inches per minute.

The production rate was 41 kilograms per hour (90 lb per hour) and a delivery speed of 137 meters per minute. The sliver weight was 4.9 ktex (70 grains per yard) and operating on a fibrous feedstock in the form of cotton which was a mixture of American types.

The weight of individual flat strips removed for given speeds of (X) of the revolving flats was as set out below:

| Revolving flat speed | Weight of individual single flat strips |
|---|---|
| 6.25 inches per minute | 1.37 grammes |
| 18 inches per minute | 1.03 grammes |
| 30 inches per minute | 0.91 grammes |
| 42 inches per minute | 0.84 grammes |
| 49 inches per minute | 0.83 grammes |

It will be noted from the above table that the weight of individual single flat strips reduces with increasing speed of the revolving flats, but the reduction in weight of each individual strip is much more than compensated for by the increased speed of the revolving flats, so that per unit of time, greater total weights of that material are removed.

Figure 2:
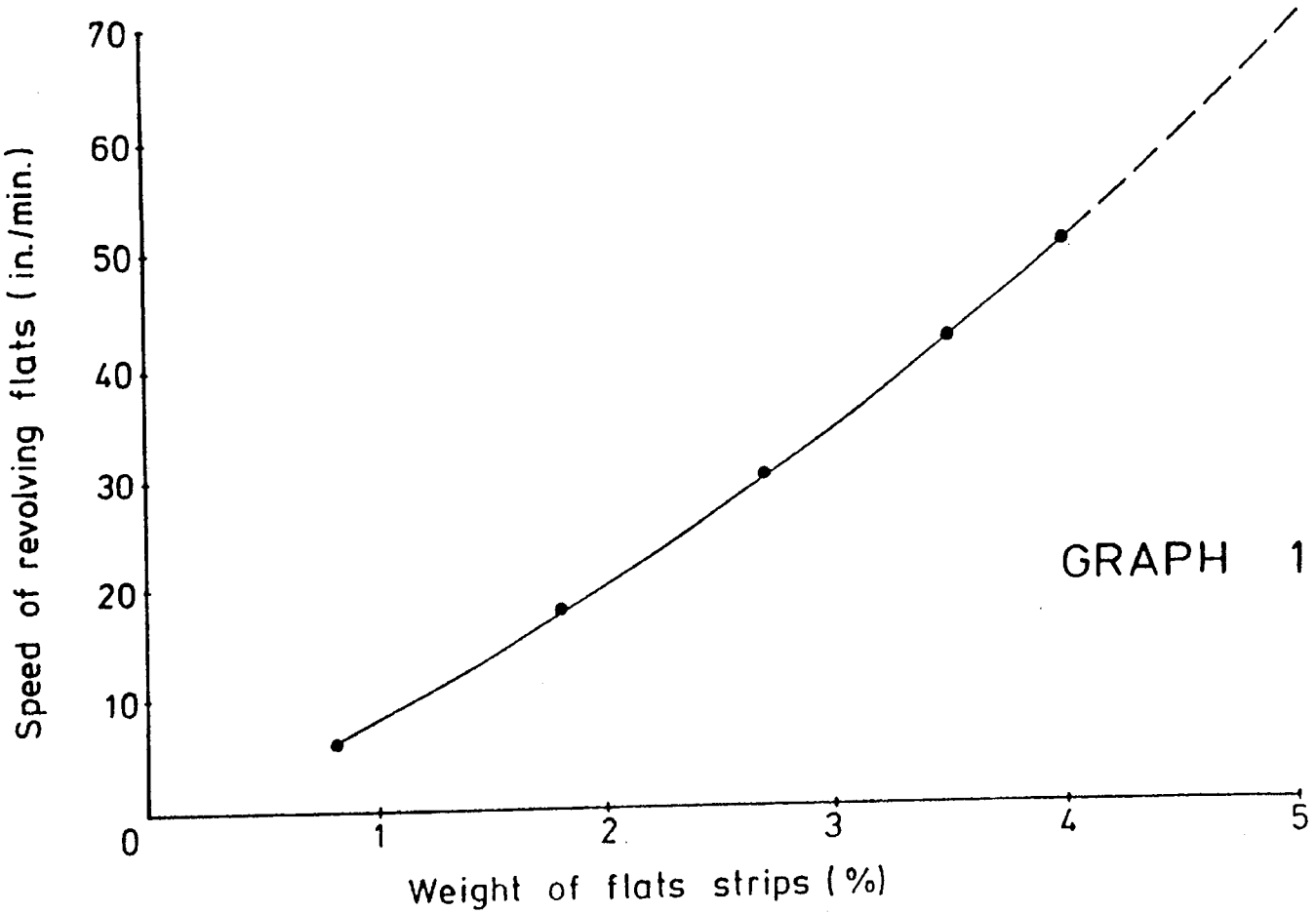
Figure 2A:
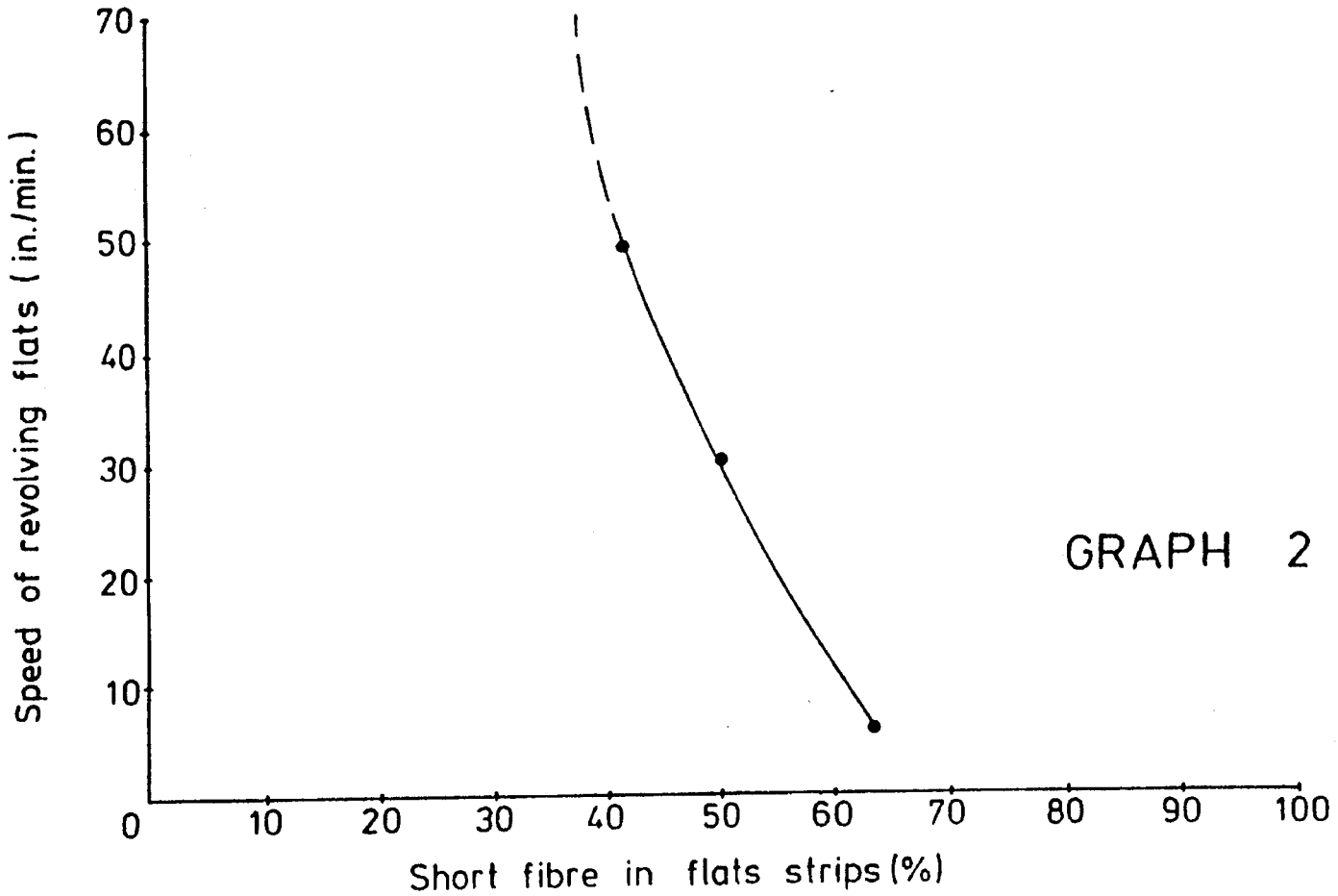
Figure 2B:
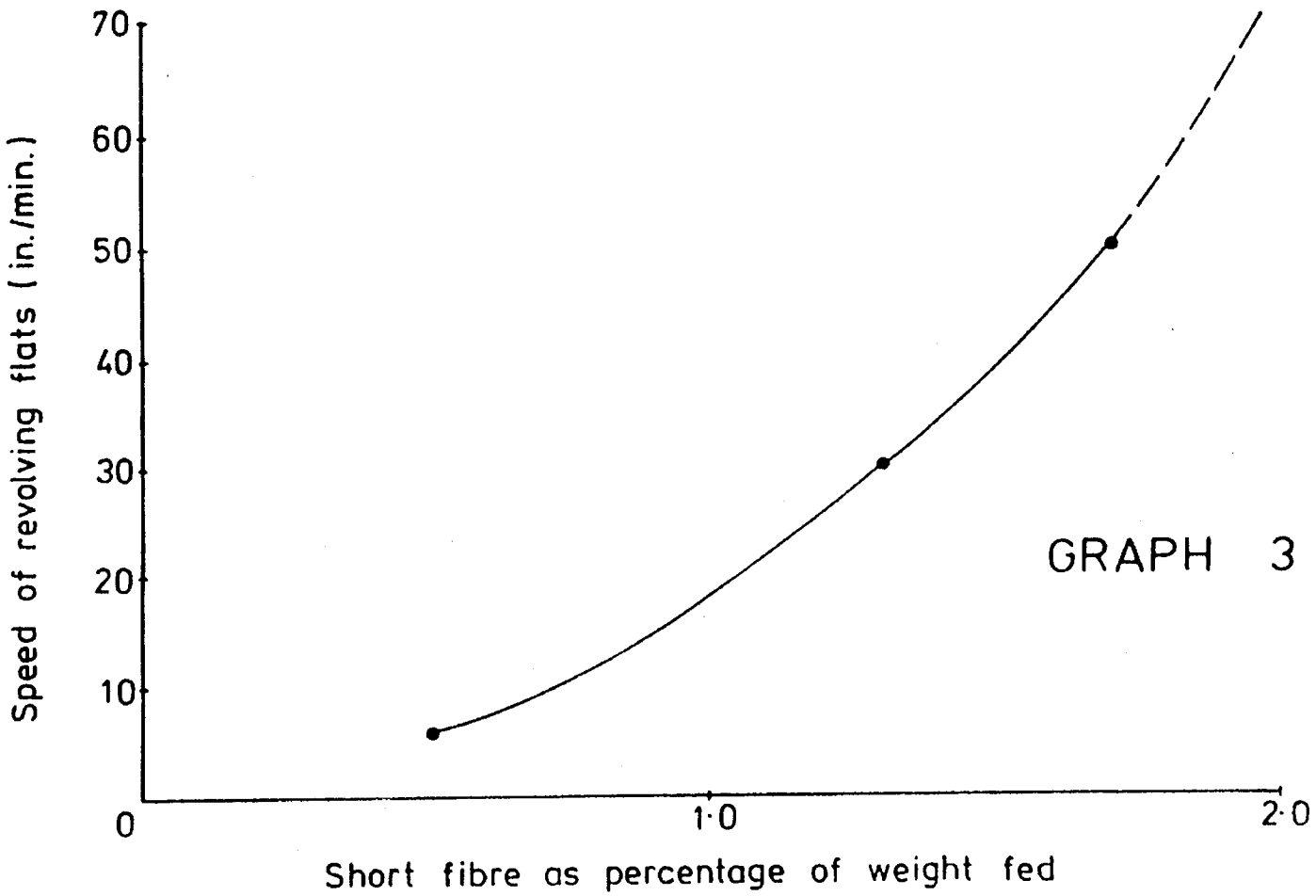

Reference should now be had to FIG. 2 having graphs 1, 2 and 3. The Y axis gives the speed of the revolving flats, and the X axis in Graph 1 shows the variation in the weight of the flat strips, as a percentage of the feedstock. In Graph 2, there is shown the percentage of short fibres in the flat strips, and Graph 3 shows variation in the percentage of short fibre removed from the feedstock with variation in flat speed. In graph 1, the percentage of the flats strip increases almost linearly. In graph 2, the percentage of short fibre present in the flats strip shows a reduction in the short fibre proportion with increase of flats speed. Graph 3 shows the short fibre proportion as a percentage of weight fed, and this shows substantial increase in removal of short fibre with increase in the speed of the flats.

There will now be described, by way of example only, the results of some comparative test data on sliver samples A and B, carried out on a Crosrol Mk 4 single card under similar operating conditions to those referred earlier, in which sample A is produced by running the flats at normally accepted speed of 6.25 inch per minute, and sample B produced by increase in flat speed to 49 inch per minute as an example which is within the scope of the invention.

The sliver of sample A is then subjected to subsequent combing treatment as specified, and compared with the sliver of sample B as produced by a carding method of the invention with increased speed of the flats.

The comparative test data is given below:

| Crosrol Mk 4 single card | Samples A | Samples B |
|---|---|---|
| Flat speed (inches per minute) | 6.25 | 49 |
| Weight of flat strips (%) | 1.27 | 4.56 |
| Scratch combed | Yes | No |
| Comber noils extraction (%) | 9.50* | 0 |
| Total card strips and comber wastes (%) | 10.77 | 4.56 |
| Difference in total fibre loss between A and B | 6.21 | |

*A scratch combed sliver is normally with a 6–8% comber noil extraction, whilst full combing of sliver involves the extraction of 14–18% comber noils.

Surprisingly the knitted, dyed and finish rotor spun fabrics derived from samples A and B were virtually indistinguishable.

The experimental data shown above is by way of example only. Further experiments remain to be carried out, but are expected to show that advantageous effects are achieved in sliver production with values of flat speed increased to as little as 16 inches per minute and/or for the ratio of flats speed (X) to cylinder circumferential speed (Y), to be increased from normal rate by at least 50% e.g. from 1:10,000 to 1.5:10,000.

It is believed that further advantages may be obtained by having two or more separate assemblies of revolving flats above the cylinder.

Improved cleaning efficiency and nep removal is also obtained by the invention.

We claim:

1. A method of carding a fibrous feedstock to form a carded sliver, comprising the steps of:

providing a carding engine having a main toothed wire rotating cylinder, a taker-in, a doffer, and a series of flats movable along a closed loop having a working path arranged alongside an outer periphery of the cylinder between the taker-in and the doffer;

carrying out a carding operation on the feedstock in cooperation with teeth of the rotating cylinder;

removing trash particles, nep, dust and short fibers from the feedstock, the flats having a linear speed along the working path of X inches per minute and the outer periphery of the rotating cylinder having a cylinder peripheral speed of Y inches per minute; and providing a ratio of X:Y greater than 1.24:10,000 so that a resulting sliver may approach the quality of a carded, and subsequently semi-combed (scratch-combed) or combed sliver.

2. A method according to claim 1, further comprising increasing the linear speed X of the flats to the cylinder peripheral speed Y so that the ratio of X:Y is increased by a factor of at least 1.5 from 1.24:10,000.

3. A method according to claim 1, further comprising increasing the linear speed X of the flats to the cylinder peripheral speed Y so that the ratio X:Y is increased by a factor in excess of 5 from 1.24:10,000.

4. A method according to claim 1, further comprising increasing the linear speed X of the flats to the cylinder peripheral speed Y so that the ratio of X:Y is increased by up to ten times from 1.24:10,000.

5. A method according to claim 1, further comprising providing the ratio of the linear speed X of the flats to the cylinder peripheral speed Y of at least 1.5:10,000.

6. A method according to claim 5, further comprising providing the ratio of the linear speed X of the flats to the cylinder peripheral speed Y of at least 8:10,000.

7. A method according to claim 1, further comprising providing the cylinder with a 40 inch diameter and which runs at 500 rpm and the linear speed of the flats of at least 10 inches per minute.

8. A method according to claim 7, further comprising providing the linear speed X of the flats of at least 16 inches per minute.

9. A method according to claim 7, further comprising providing the linear speed X of the flats of up to 20 inches per minute.

10. A method according to claim 7, further comprising providing wherein the linear speed X of the flats of up to 50 inches per minute.

11. A method of carding a fibrous feedstock to form a carded sliver using a carding engine having a main toothed wire rotating cylinder, a taker-in, a doffer, and a series of flats movable along a closed loop having a working path arranged alongside an outer periphery of the cylinder between the taker-in and the doffer;

carrying out a carding operation on the feedstock in cooperation with teeth of the rotating cylinder;

removing waste, trash particles, and short fibers from the feedstock; and running the cylinder at a speed of up to 60,000 inches per minute and providing the linear speed of the flats of a substantially increased speed compared to normal running speeds, and is at least 16 inches per minute.

12. A method according to claim 11, further comprising providing wherein a peripheral speed of the cylinder of at least 60,000 per minute.

13. A method according to claim 12, further comprising providing the peripheral speed of the cylinder up to 120,000 inches per minute.

14. A method according to claim 13, further comprising supporting each of the movable flats by a roller bearing type of support which is movable along a flexible bend of the carding engine which controls setting of the working path.

15. A method according to claim 14, further comprising moving the flats in a co-current direction with respect to a direction of rotation of the outer periphery of the cylinder.

16. A method according to claim 14, further comprising moving the flats along the working path in a direction which is counter-current to a direction of rotation of the outer periphery of the cylinder.

* * * * *